US006540084B2

(12) United States Patent
Silvers

(10) Patent No.: US 6,540,084 B2
(45) Date of Patent: Apr. 1, 2003

(54) COMPACT PORTABLE PACK FOR CARRYING DIAPERS, WET BABY WIPES AND RECLOSABLE DISPOSABLE BAGS

(76) Inventor: Brian Silvers, 1760 Fox Field Dr., Belvidere, IL (US) 61008

( * ) Notice: Subject to any disclaimer, the term of this patent is extended or adjusted under 35 U.S.C. 154(b) by 54 days.

(21) Appl. No.: 09/871,754

(22) Filed: Jun. 1, 2001

(65) Prior Publication Data

US 2002/0179478 A1 Dec. 5, 2002

(51) Int. Cl.[7] ..... B65D 25/04

(52) U.S. Cl. ..... 206/581; 206/494; 206/812; 220/524

(58) Field of Search ..... 206/440, 494, 206/581, 821; 220/826, 849, 504, 524

(56) References Cited

U.S. PATENT DOCUMENTS

| | | | | | |
|---|---|---|---|---|---|
| 1,577,566 | A | * | 3/1926 | Cryder | 43/57.2 |
| 2,573,766 | A | * | 11/1951 | Hyman | 150/110 |
| D285,906 | S | | 9/1986 | Tyler | D9/425 |
| 4,685,559 | A | | 8/1987 | Titus | 206/38 |
| 4,706,845 | A | | 11/1987 | Schnurer et al. | 221/102 |
| 4,848,585 | A | * | 7/1989 | Snyder | 206/566 |
| 4,898,273 | A | * | 2/1990 | Kristiansen | 206/204 |
| D310,748 | S | | 9/1990 | Embree et al. | D34/40 |
| 4,961,522 | A | | 10/1990 | Weber | 224/151 |
| D314,279 | S | | 2/1991 | Hotchkiss | D3/30.1 |
| 5,036,997 | A | | 8/1991 | May et al. | 220/335 |
| 5,117,979 | A | | 6/1992 | Brightbill | 206/372 |
| D329,135 | S | | 9/1992 | Embree | D3/30.1 |
| D330,161 | S | | 10/1992 | Schuh | D9/423 |
| 5,423,419 | A | * | 6/1995 | Wentz et al. | 220/849 |
| 5,433,373 | A | | 7/1995 | Zoeller | 229/117.26 |
| 5,443,161 | A | | 8/1995 | Jonese | 206/581 |
| D367,172 | S | | 2/1996 | Brightbill et al. | D3/310 |
| D367,609 | S | | 3/1996 | Frank et al. | D9/425 |
| D371,030 | S | | 6/1996 | Hall | D6/515 |
| 5,624,095 | A | | 4/1997 | Zissu | 248/231.81 |
| 5,638,957 | A | | 6/1997 | Brasier | 206/581 |
| 5,655,680 | A | | 8/1997 | Asbach et al. | 220/404 |
| 5,678,727 | A | | 10/1997 | Rice | 221/98 |
| 5,706,950 | A | | 1/1998 | Houghton et al. | 206/581 |
| 5,868,227 | A | * | 2/1999 | Garcia | 190/112 |
| D412,439 | S | | 8/1999 | Cormack | D9/425 |
| 5,957,325 | A | * | 9/1999 | Montanez | 221/131 |
| 6,164,442 | A | * | 12/2000 | Stravitz | 220/522 |
| 6,182,022 | B1 | | 1/2001 | Mayle et al. | 702/182 |
| 2001/0035416 | A1 | * | 11/2001 | Dodson | 206/581 |

* cited by examiner

*Primary Examiner*—Jim Foster
(74) *Attorney, Agent, or Firm*—Leydig, Voit & Mayer, Ltd.

(57) ABSTRACT

A compact portable pack for holding diapers, wet baby wipes, and reclosable disposable bags. The pack comprises a container base of plastic material comprising a rectangular sidewall and a partition wall. The rectangular sidewall extends between two opposing ends and includes pairs of parallel sides. The partition wall intersects all sides separating the container base into a wipe compartment at one end and a diaper compartment at the other end. The wipe compartment holds wet baby wipes while the diaper compartment holds diapers. Lids of plastic material are integrally hinged to the rectangular on different sides and at opposite ends of the container base. Each lid is movable between open and closed positions. In the closed position the lids engage the container base to close the diaper compartment and wipe compartment. A resilient clip is supported by the lid covering the diaper compartment and retains reclosable disposable bags.

24 Claims, 4 Drawing Sheets

COMPACT PORTABLE PACK FOR CARRYING DIAPERS, WET BABY WIPES AND RECLOSABLE DISPOSABLE BAGS

FIELD OF THE INVENTION

The present invention relates generally to storage apparatus for facilitating changing of diapers, and more particularly relates to portable holding devices for holding supplies for diaper changes.

BACKGROUND OF THE INVENTION

Parents change the diapers of babies frequently and often several times per day. In will readily be appreciated by parents everywhere that changing the diapers of babies is a difficult task. Many parents have been frustrated by the absence of any good products on the market for assisting parents in the diaper changing task in a convenient manner.

BRIEF SUMMARY OF THE INVENTION

The present invention is directed toward a compact portable pack for holding diapers, wet baby wipes, and reclosable disposable bags. The pack comprises a container base of resilient plastic material comprising a rectangular sidewall and a partition wall. The rectangular sidewall extends between two opposing ends and includes pairs of parallel sides. The partition wall intersects all sides separating the container base into a wipe compartment at one end and a diaper compartment at the other end. The wipe compartment holds wet baby wipes while the diaper compartment holds diapers. Lids of plastic material are integrally hinged to the sidewall on different sides and at opposite ends of the container base. Each lid is movable between open and closed positions. In the closed position the lids engage the container base to close the diaper compartment and wipe compartment. A resilient clip is supported by the lid covering the diaper compartment and retains reclosable disposable bags.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

Figure 1:
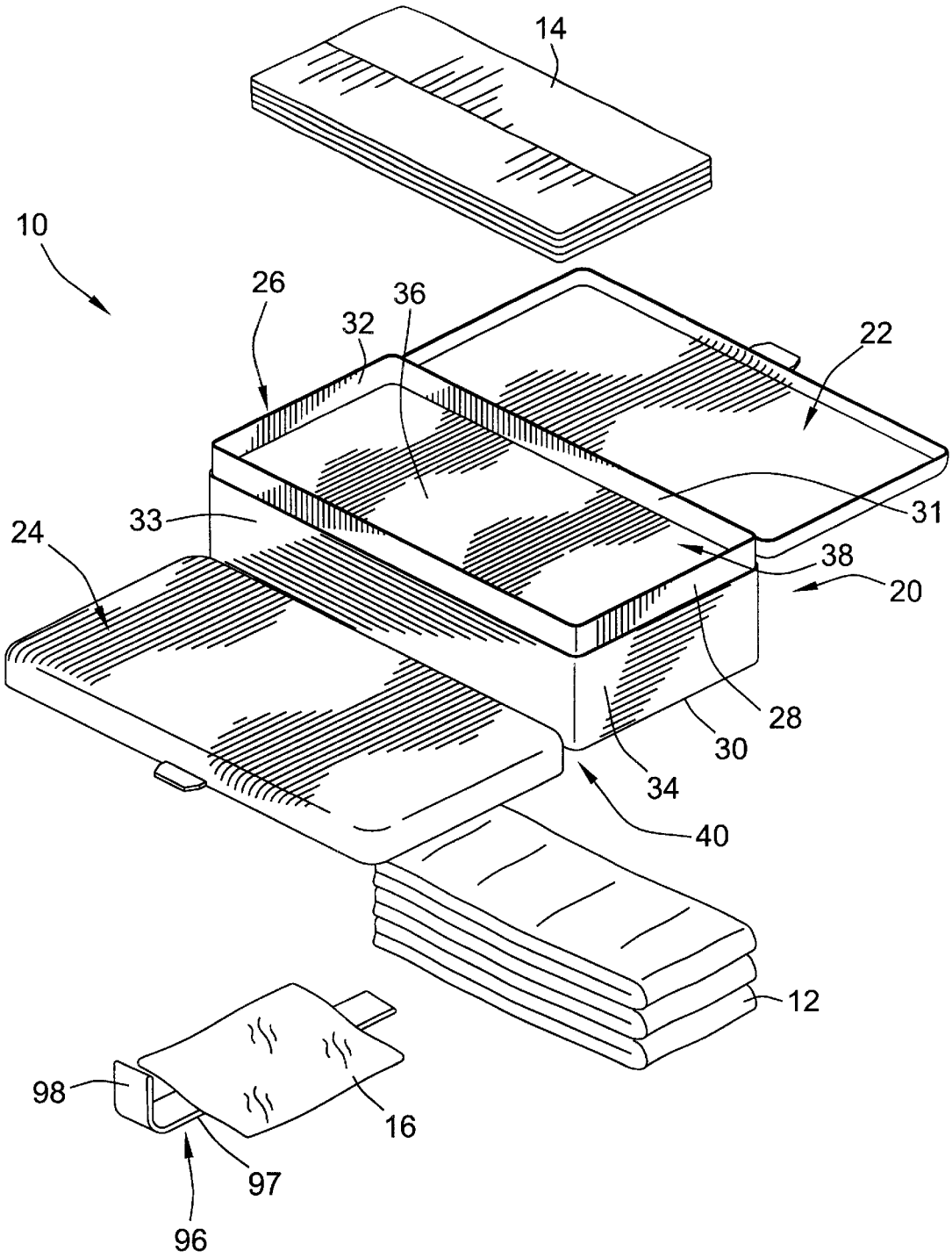
FIG. 1 is an exploded isometric view of a compact portable pack for holding diapers, wet baby wipes, and reclosable disposable bags.
Figure 2:
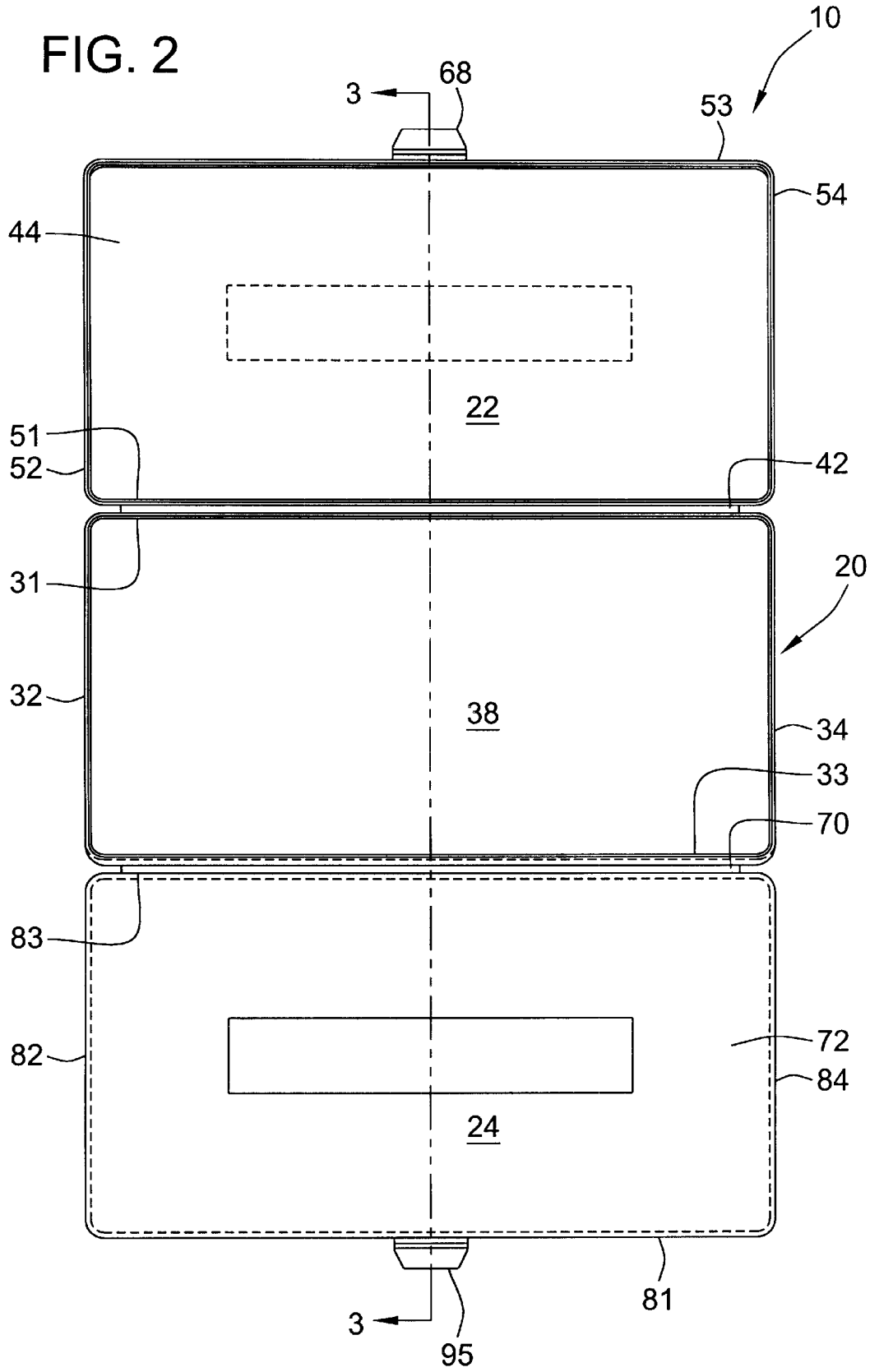
FIG. 2 is a plan view of a compact portable pack for holding diapers, wet baby wipes, and reclosable disposable bags shown in FIG. 1.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

For purpose of illustration, the present invention has been depicted as a compact portable pack 10 for holding diapers 12, wet baby wipes 14, and reclosable disposable plastic bags 16. A mother or father can conveniently carry the pack 10 about keeping the necessary supplies required to change the diaper of a baby readily available for use upon demand. The pack 10 is compact and is capable of being carried in a tote bag, a larger purse, compartment of a car, and in other convenient ways.

The pack 10 comprises a relatively rigid container base 20 of resilient plastic material having integrally formed lids 22, 24 attached thereto. The container base 20 is generally rectangular comprising an outer sidewall 26 extending opposing ends 28, 30. When opening or closing one of the lids 22, 24, the sidewall 26 is typically oriented with the vertical orientation of the sidewall illustrated in FIG. 4 (or rotated about 180 degrees in which the sidewall is still vertical). The reference to vertical and horizontal using the orientation illustrated in FIG. 4 will be used herein and throughout for purposes of reference for description purposes even though the lids can be opened while the sidewall rotated to a horizontal orientation. The sidewall 26 is comprised of four upright sides 31, 32, 33, 34. The first and third sides 31, 33 extend parallel. Similarly, the second and fourth sides 32, 34 extend parallel. A partition wall 36 extends horizontally perpendicular to the sidewall 26 to divide the container base 20 into a wipe compartment 38 and a diaper compartment 40 at opposing ends 28, 38 of the container base 20. Thus, the partition wall 36 forms the bottom of each of the compartments 38, 40. The diaper compartment 40 may be sized to hold a maximum of about 2–6 diapers while the wipe compartment 38 is sized to hold a maximum of 10 to 20 wet baby wipes.

Figure 3:
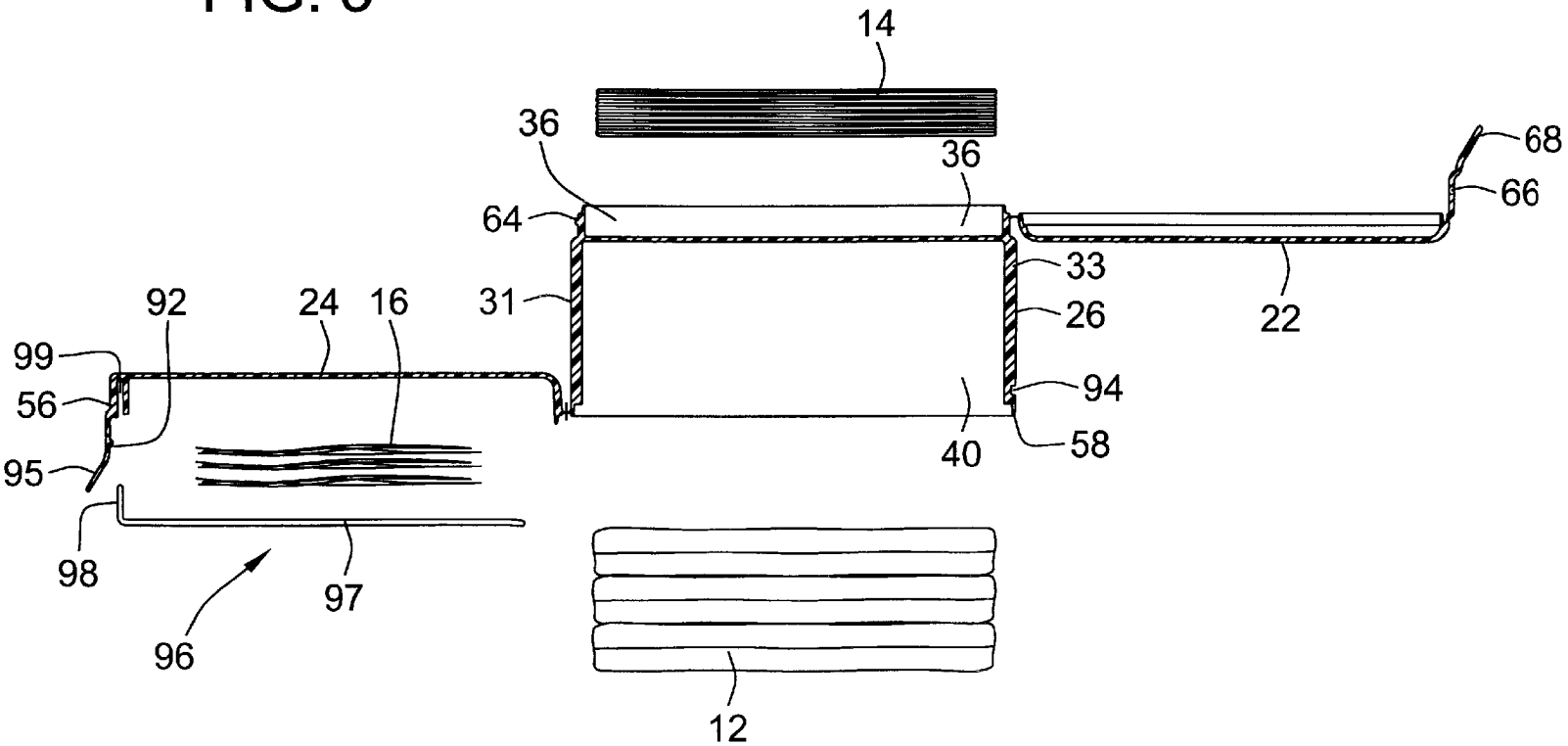
FIG. 3 is a cross section of the compact portable pack illustrated in FIG. 2 taken about line 3—3 with diapers, wet baby wipes, and reclosable disposable bags being shown in an exploded type view.

The first lid 22 is integrally connected to the first side 31 at the first end 28 through a live hinge 42 which is a thin flexible web of plastic material. The first lid 22 pivots via the hinge 42 between open and closed positions shown in FIGS. 3 and 4, respectively. The first lid 22 includes a planar horizontal rectangular cover portion 44 and first, second, third, and fourth vertically depending end walls 51–54 complementary to and aligned with the sides 31–34 of the container base 22 when in the closed position of FIG. 4. The end walls 51–54 engage the sides 31–34 to enclose the wipe compartment 38. A seal in the preferred form of a tongue and groove seal 55 is arranged between the lid 22 and the sidewall 26. The seal 55 prevents liquid contained in the wet baby wipes 14 from evaporating. The tongue and groove seal 55 comprises a vertical groove 56 formed in the terminating edge of the second, third and fourth end walls 52–54, and a tongue 58 projecting vertically from the sidewall 26 at the first end 28 into the vertical groove 56. The groove 56 does not extend along the first end wall 51 due to the fact that it would be difficult to get the tongue into the groove along a horizontal line so close to the pivot point of the hinge 42. Instead, only the outer groove wall 60 of the groove 56 extends along the first end wall 51. The tongue 58 and outer groove wall 60 engage and horizontally interfere with each other to maintain a seal along the first side 31 of the wipe compartment 38.

To keep the lid 22 closed and sealed on the container base 20, a snap connection 62 is provided between the lid 22 and base 20 on the side opposite the live hinge 42. The snap connection 62 is formed by an interlocking rib 64 and cavity 66 between the container base 24 and the lid 22. In the disclosed embodiment, the cavity 66 is formed into a resilient lift tab 68 projecting outwardly and vertically from the third end wall 53 of the lid 22. The lift tab 68 extends over the exterior of the container base sidewall 26 with the cavity 66 receiving the rib 64 that projects outwardly from the third side 33. The lift tab 58 can be pulled and flexed outwardly to unsnap the snap connection 62 and release the lid 22 from the container base 20 to open the wipe compartment 38.

The second lid 24 is integrally connected to the third side 33 at the second end 28 through a live hinge 70 which is a thin flexible web of the plastic material. It is an advantage that the lids 22, 24 are integrally connected on different sides and preferably opposite sides of the container base 20 for manufacturing in that a two or three piece mold may be used with three plastic injection points during the blow molding process, one for the container base, and one for each lid. The second lid 24 pivots via the live hinge 70 between open and closed positions shown in FIGS. 3 and 4, respectively. The second lid 24 includes a planar horizontal rectangular cover portion 44 and first, second, third, and fourth vertically depending end walls 81–84 complementary to and aligned with the sides 31–34 of the container base 22 when in the closed position of FIG. 4. The end walls 81–84 engage the sides 31–34 to enclose the diaper compartment 40. To prevent dirt or other undesirable material from entering the diaper compartment 40, the lid includes thin rectangular flange 86 projecting vertically toward the container base 20 from the end walls 81–84 that surrounds and interferes with a corresponding thin rectangular flange 88.

To keep the second lid 24 closed and sealed on the container base 20, a snap connection 90 is provided between the lid 24 and base 20 on the side opposite the live hinge 70. The snap connection 90 is formed by an interlocking rib 92 and cavity 94 between the container base 20 and the lid 24. In the disclosed embodiment, the rib 92 is formed into a resilient lift tab 95. The lift tab 95 projects outwardly and vertically from the first end wall 81 of the lid 24. The lift tab 95 extends over the exterior of the container base sidewall 26 with the rib 92 projecting into the cavity 94 formed in the first side 31 of the container base. The lift tab 95 can be pulled and flexed outwardly to unsnap the snap connection 90 and release the lid 24 from the container base 20 to open the diaper compartment 40.

Figure 4:
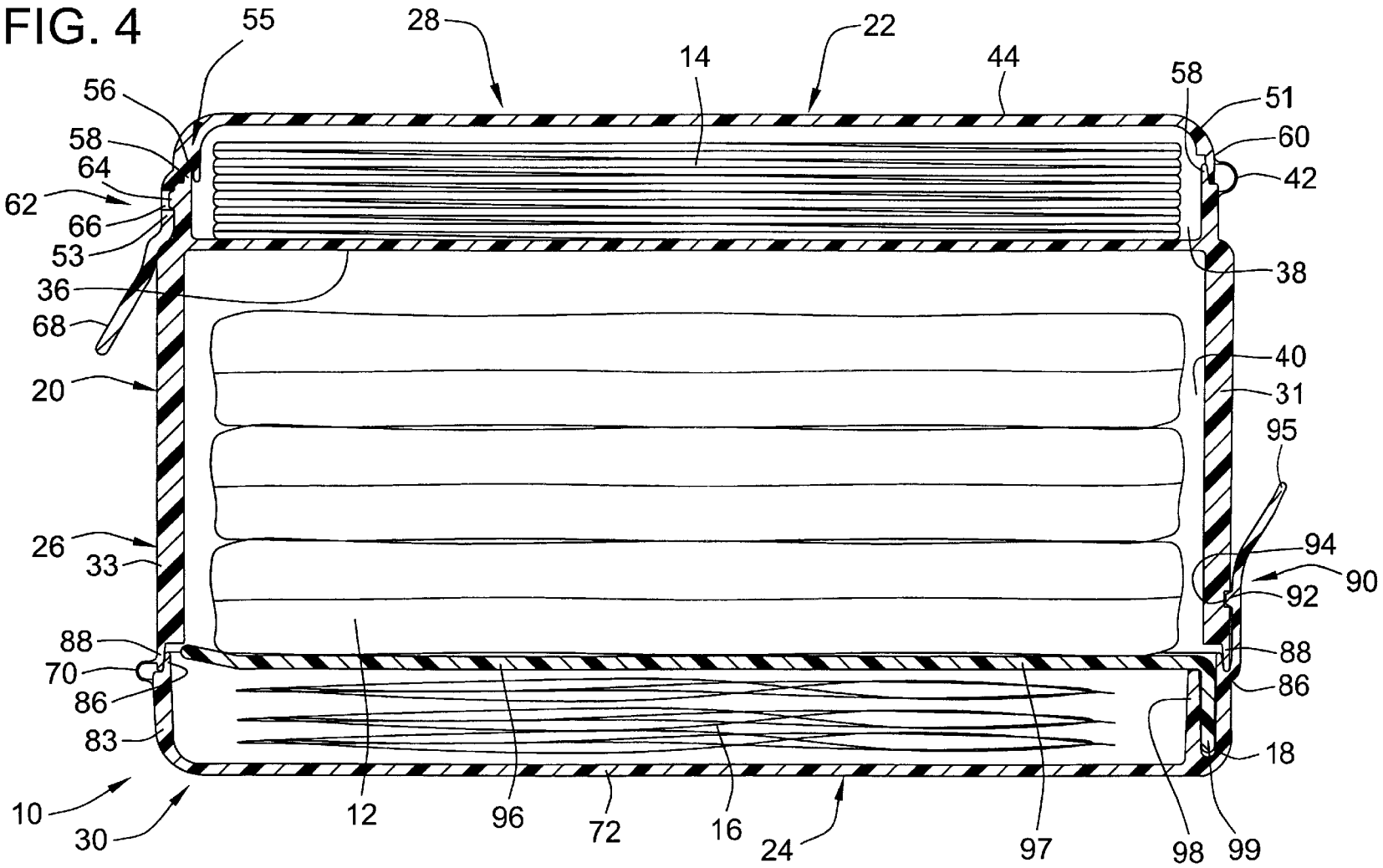
FIG. 4 is a cross section similar of the compact portable pack to FIG. 2 but with the lids in the closed position with diapers, wet baby wipes, and reclosable disposable bags shown properly contained therein.

The second lid 24 also supports a resilient spring clip 96 in the recessed chamber formed between end walls 81–84 of the lid 24. As shown in FIG. 4, the spring clip 96 includes a horizontal portion 97 extending substantially the full width between opposing end walls 81, 83. A slightly arched vertical portion 98 is joined to an end of horizontal portion 97. The spring clip 96 is fit into a formed groove or slot 99 of the second lid 24 with a tight interference fit such that the clip 96 is not intended to be removed and a large removing force is required to remove the clip 96. The horizontal portion 97 can be pivoted to provide clearance space for receiving, storing and removing reclosable disposable bags 16 such as plastic zip lock bags, plastic bags or other suitable bags. The bags 16 are used to store soiled baby wipes and diapers from a baby changing operation to allow for easy disposal.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A compact portable pack, comprising:

a container base having a wipe compartment formed into a first end and a diaper compartment formed into a second end opposite said first end, the container base including a sidewall surrounding the diaper compartment and the wipe compartment, the container base further including a partition wall extending across the sidewall separating the diaper compartment and the wipe compartment;

a plurality of wet baby wipes contained in the wipe compartment;

a plurality of diapers contained in the diaper compartment;

a first lid engaging the sidewall at the first end enclosing the wipe compartment; and a second lid engaging the sidewall at the second end enclosing the diaper compartment.

2. The compact portable pack of claim 1 further comprising a seal between the first lid and the wipe compartment preventing liquid contained in the wet baby wipes from evaporating.

3. The compact portable pack of claim 2 wherein the seal is a tongue and groove seal.

4. The compact portable pack of claim 1 wherein the container base is comprised of resilient plastic material, the first and second lids being integrally hinged to the sidewall at the first and second ends, respectively.

5. The compact portable pack of claim 4 wherein the sidewall includes a plurality of sides, wherein the first and second lids are hinged to different sides of the sidewall.

6. The compact portable pack of claim 5 further comprising a resilient lift tab on each of the first and second lids, the lift tab arranged on each lid on a side opposite the side in which the lid is hinged to the sidewall, the lift tab including a snapping structure coacting with a corresponding snapping structure on the sidewall, each lid opening by lifting the lift tab thereby unsnapping the lid.

7. The compact portable pack of claim 1 wherein the diaper compartment is dimensioned to hold a maximum of between 2 and 6 diapers and wherein the wipe compartment is dimensioned to hold a maximum of between 10 and 20 wet baby wipes.

8. The compact portable pack of claim 1 wherein the second lid includes a recess exposed to the diaper compartment, further comprising a spring clip supported by the second lid retaining a plurality of disposable bags in the recess.

9. The compact portable pack of claim 8, wherein the spring clip is a separate part from the container base and the first and second lids, the spring clip including a horizontal portion joined to a vertical portion, the vertical portion fitted into a slot formed in the second lid, the horizontal portion extending between a pair of the end walls.

10. A compact portable pack, comprising:

a container base having a wipe compartment formed into a first end and a diaper compartment formed into a second end opposite said first end, the container base including a sidewall surrounding the diaper compartment and the wipe compartment, the container base further including a partition wall extending across the sidewall separating the diaper compartment and the wipe compartment;

the wipe compartment adapted to contain a plurality of wet baby wipes;

the diaper compartment adapted to contain a plurality of diapers;

a first lid engaging the sidewall at the first end enclosing the wipe compartment; and a second lid engaging the sidewall at the second end enclosing the diaper compartment, wherein the second lid includes a recess exposed to the diaper compartment, further comprising a spring clip supported by the second lid adapted to retain a plurality of disposable bags.

11. The compact portable pack of claim 10 further comprising a seal between the first lid and the wipe compartment preventing liquid contained in the wet baby wipes from evaporating.

12. The compact portable pack of claim 11 wherein the seal is a tongue and groove seal.

13. The compact portable pack of claim 10 wherein the container base is comprised of resilient plastic material, the first and second lids being integrally hinged to the sidewall at the first and second ends, respectively.

14. The compact portable pack of claim 13 wherein the sidewall includes a plurality of sides, wherein the first and second lids are hinged to different sides of the sidewall.

15. The compact portable pack of claim 14 further comprising a resilient lift tab on each of the first and second lids, the lift tab arranged on each lid on a side opposite the side in which the lid is hinged to the sidewall, the lift tab including a snapping structure coacting with a corresponding snapping structure on the sidewall, each lid opening by lifting the lift tab thereby unsnapping the lid.

16. The compact portable pack of claim 10 wherein the diaper compartment is dimensioned to hold a maximum of between 2 and 6 diapers and wherein the wipe compartment is dimensioned to hold a maximum of between 10 and 20 wet baby wipes.

17. The compact portable pack of claim 10, wherein the spring clip is a separate part from the container base and the first and second lids, the spring clip including a horizontal portion joined to a vertical portion, the vertical portion fitted into a slot formed in the second lid, the horizontal portion extending between a pair of the end walls.

18. A compact portable pack for holding diapers, wet baby wipes, and disposable bags, comprising:

a container base of plastic material comprising a rectangular sidewall and a partition wall, the rectangular sidewall extending between first and second ends, the sidewall including first, second, third, and fourth sides, the first and third sides being parallel, the second and fourth sides being parallel, the partition wall intersecting the first, second, third and fourth sides separating the container base into a wipe compartment at the first end and a diaper compartment at the second end, each compartment being enclosed by the first, second, third and fourth sides, the wipe compartment adapted to hold the wet baby wipes, the diaper compartment adapted to hold the diapers;

a first lid of plastic material integrally hinged to the first side at the first end, the first lid engaging the container base in a closed position to enclose the wipe compartment, the first lid movable from the closed position to an open position;

a second lid of plastic material integrally hinged to the third side at the second end, the second lid engaging the container base in a closed position to enclose diaper compartment; and a resilient clip supported by the second lid adapted to retain the disposable bags.

19. The compact portable pack of claim 18 further comprising a seal between the first lid and the sidewall for preventing liquid in wet baby wipes from evaporating when contained in the wipe compartment.

20. The compact portable pack of claim 19 wherein the seal comprises tongue and groove seal.

21. The compact portable pack of claim 19 further comprising a resilient lift tab on each of the first and second lids, the lift tab arranged on each lid on a selected side opposite the side in which the lid is hinged to the sidewall, the lift tab including a snapping structure coacting with a corresponding snapping structure on the sidewall, each lid opening by lifting the lift tab thereby unsnapping the lid.

22. The compact portable pack of claim 19 wherein the diaper compartment is dimensioned to hold a maximum of between 2 and 6 diapers and wherein the wipe compartment is dimensioned to hold a maximum of between 10 and 20 wet baby wipes.

23. The compact portable pack of claim 19 wherein the second lid includes a recess exposed to the diaper compartment, further comprising a spring clip supported by the second lid adapted to retain a plurality of disposable bags.

24. The compact portable pack of claim 23, wherein the spring clip is a separate part from the container base and the first and second lids, the spring clip including a horizontal portion joined to a vertical portion, the vertical portion fitted into a slot formed in the second lid, the horizontal portion extending between a pair of the end walls.

* * * * *